United States Patent [19]

Passoni et al.

[11] 4,201,097

[45] May 6, 1980

[54] DEVICE FOR LOCKING AND RELEASING THE MANDREL-HOLDING CARRIAGE OF A PIERCING PRESSURE MILL

[75] Inventors: Teresio Passoni, Magenta; Alberto Mascheroni, Cormano, both of Italy; Jean P. Calmes, Lausanne, Switzerland

[73] Assignee: Innocenti Santeustacchio S.p.A., Brescia, Italy

[21] Appl. No.: 897,544

[22] Filed: Apr. 18, 1978

[30] Foreign Application Priority Data

May 19, 1977 [IT] Italy ..... 23754 A/77

[51] Int. Cl.[2] ..... G05G 5/06

[52] U.S. Cl. ..... 74/529; 74/520

[58] Field of Search ..... 74/520, 529; 292/201

[56] References Cited

U.S. PATENT DOCUMENTS 3,854,763 12/1974 Zawadzki et al. ..... 292/201

*Primary Examiner*—Kenneth Dorner

*Attorney, Agent, or Firm*—Birch, Stewart, Kolasch & Birch

[57] ABSTRACT

A device for locking and releasing the mandrel-holding carriage of a piercing pressure mill, the device comprising at least one lever having an end pivoted to a horizontal pivot perpendicular to the mandrel axis, the other end of the lever being free and removably engaging an abutment formed in the carriage, and at least one substantially toggle mechanism having one end pivoted to the lever which cooperates with a means for actuating the mechanism to form a double toggle for angularly moving the lever around its pivot axis from a position in which its free end engages the abutment to a position in which its free end is completely released from the abutment.

4 Claims, 4 Drawing Figures

DEVICE FOR LOCKING AND RELEASING THE MANDREL-HOLDING CARRIAGE OF A PIERCING PRESSURE MILL

BACKGROUND OF THE INVENTION

The invention relates to a device for locking and releasing the mandrel-holding carriage of a piercing pressure mill. The device comprises at least one lever having an end pivoted to a horizontal pivot perpendicular to the mandrel axis, the other end of the lever being free and releasably engaging an abutment formed in the carriage.

A piercing pressure mill, hereinafter denoted by the symbol PPM, is a machine for converting a square bar into a corresponding round, axially perforated bloom. A PPM mainly comprises a pair of rolling units, including rollers having round grooves, a mandrel having a drill bit extending along the rolling axis from the outlet side of the pair of rolling units, and a thrust member constructed and dimensioned so as to drive a square bar between the grooves of the pair of rolling units against the drill bit.

The mandrel or chuck is borne by a carriage movable along the rolling and drilling axis in guides formed on a rigid structure forming part of the PPM bearing structure and disposed at the outlet side thereof. In order to drill the bar axially as required, the carriage is rigidly held in the operating position by locking means or devices which firmly resist the action of the thrust means.

It is also known that a PPM can be adapted to convert a square bar into a round bloom which is not completely drilled but has a closed end. In a widely-used system for obtaining a bloom of the last-mentioned kind, the action of the thrust means is stopped when its head is at a predetermined distance from the drill bit.

The aforementioned system has a technical drawback which has not hitherto been satisfactorily overcome, i.e. when the thrust means stops, the bar for rolling stops momentarily in that the rollers do not have sufficient strength to continue drilling against the stationary bit. The momentary stoppage of the bar causes the rollers to become loose, even though only for an instant, from the bloom, thus varying the torque in the roll-actuating means. This produces a recoil having an intensity depending on the resilience and the clearances in the actuating means, resulting in considerable, known disadvantages and damage, i.e. wear on the actuating means. These disadvantages could be obviated if the mandrel-bearing carriage could be instantaneously released when the thrust means is stopped. However, existing carriage locking means cannot be released instantaneously and are difficult to actuate due to the enormous forces acting drill bit and carriage during the drilling phase.

SUMMARY AND OBJECTS OF THE INVENTION

An object of the invention is to solve the technical problem discussed above by constructing a device for locking and releasing the mandrel-holding carriage of a PPM. The device includes structural and functional characteristics so as to instantaneously release the carriage when the thrust means stops, thus completely eliminating the recoil of the drill bit, so that the rollers can finish rolling the bloom.

To achieve this and other objects the device according to the present invention, comprises at least one substantially toggle mechanism having one end pivoted to a lever which co-operates with a means for actuating the mechanism to form a double toggle for angularly moving the lever about its pivot axis from a position in which its free end engages the abutment to a position in which its free end is completely released from the abutment.

BRIEF DESCRIPTION OF THE DRAWINGS

Other features and advantages of the invention will be clearer from the following detailed description of an embodiment of a device according to the invention with reference to the accompanying drawings, given by way of non-limitative example only, in which.

DETAILED DESCRIPTION OF THE INVENTION

Figure 1:
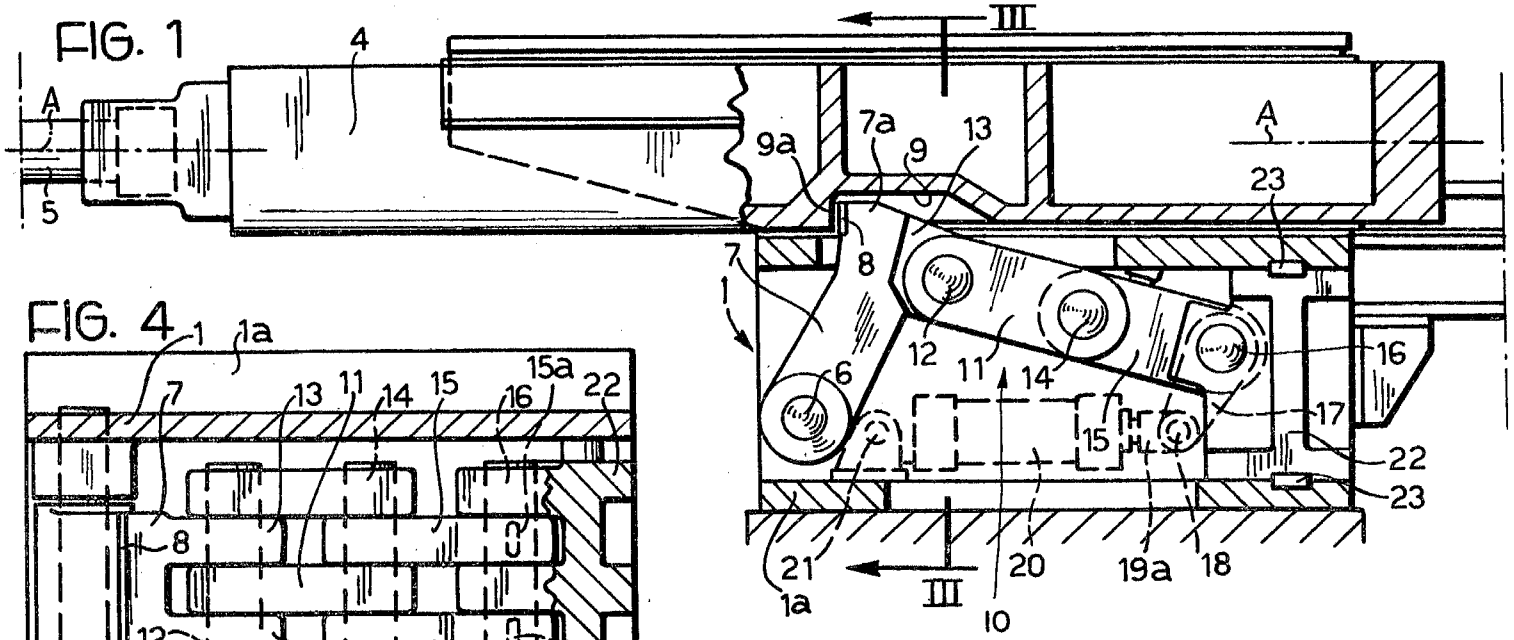
FIG. 1 is a partial cross-sectional view of toggle mechanism according to the present invention.

In the accompanying drawings, the general reference 1 denotes a bearing structure firmly secured to the ground by conventional means (not shown) in a position downstream of the outlet side of a PPM (not shown). Rectilinear guides (2, 2 and 3, 3) are formed laterally and above structure 1 and extend parallel to the rolling and drilling axis A of the PPM. A carriage 4 can reciprocate along the guides and is adapted in a conventional manner to hold a mandrel 5 in a substantially cantilever manner, the mandrel includes a drill bit diagrammatically indicated at **5*a*. Mandrel 5** extends along the PPM rolling axis A.

At the front, structure 1 bears a pin 6 extending horizontally and perpendicular to the rolling axis A. The bottom end of a lever 7 is rotatably mounted on a pin 6, and includes bearings (not shown) interpositioned therebetween. The end **7*a* of the lever is free and provided at the front with a flat iron member 8 adapted to make contact with a shoulder 9*a* of a recess or abutment 9 formed transversely at the bottom of carriage 4 in a manner described hereinafter. The axis of pin 6 is the pivot axis of lever 7, around which the lever can be angularly moved from a position in which member 8 abuts shoulder 9*a* (FIG. 1) into a position in which the top free end 7*a* of the lever is completely released from recess 9 (FIG. 2**).

Lever 7 is associated with and actuated by a substantially toggle mechanism indicated by the general reference 10.

Mechanism 10 comprises a rod 11 pivoted at one end on a horizontal pin 12. A pair of lugs 13, 13 formed at the front of the top free end **7*a* of lever 7 hold pin 12 so that its axis is parallel to pin 6**.

Figure 4:
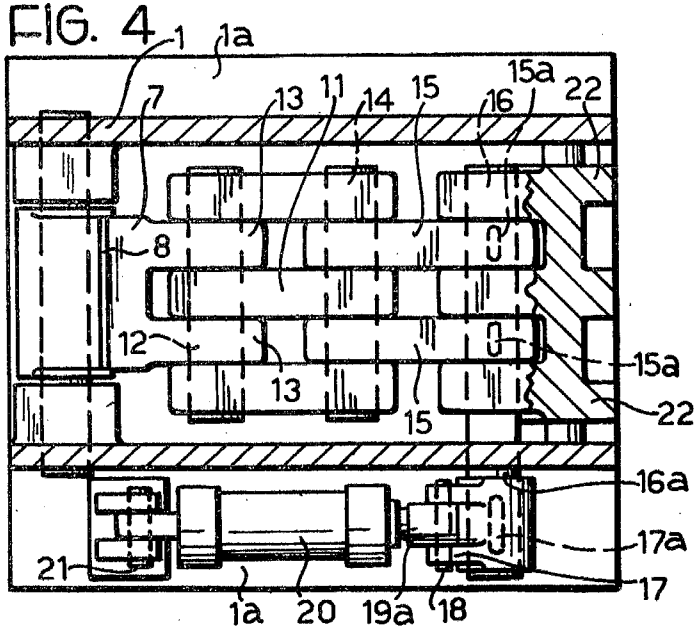
FIG. 4 is a plan view of a portion of the device shown in FIG. 1, the mandrel-holding carriage being omitted for clarity.

The other end of rod 11 is pivoted to a horizontal pin 14 having its axis parallel to pin 6. The ends of two identical, parallel rods 15, 15 are also pivoted on pin 14. The other ends of rods 15, 15 are keyed by diagrammatic means **15*a*, 15*a* to a shaft 16** rotatably borne by a member 22 secured to the structure 1 by keys 23. Shaft 16, the axis of which is parallel to pin 6 of lever 7, has a portion 16*a* which projects laterally from the bearing structure 1 (FIG. 4). Portion 16*a* of shaft 16 is keyed by conventional means diagrammatically indicated at 17*a* to a double link 17, the other end of which is pivoted on a pivot 18 parallel to shaft 16, to the free end 19*a* of a rod 19 of a double-acting hydraulic cylinder 20 borne by the baseplate 1*a* of structure 1. More particularly, cylinder 20 is supported on the baseplate 1*a* to pivot around a horizontal axis 21 parallel to pin 6, around which the cylinder can be angularly moved in a vertical plane.

Mechanism 10 and lever 7 form a double toggle.

Figure 2:
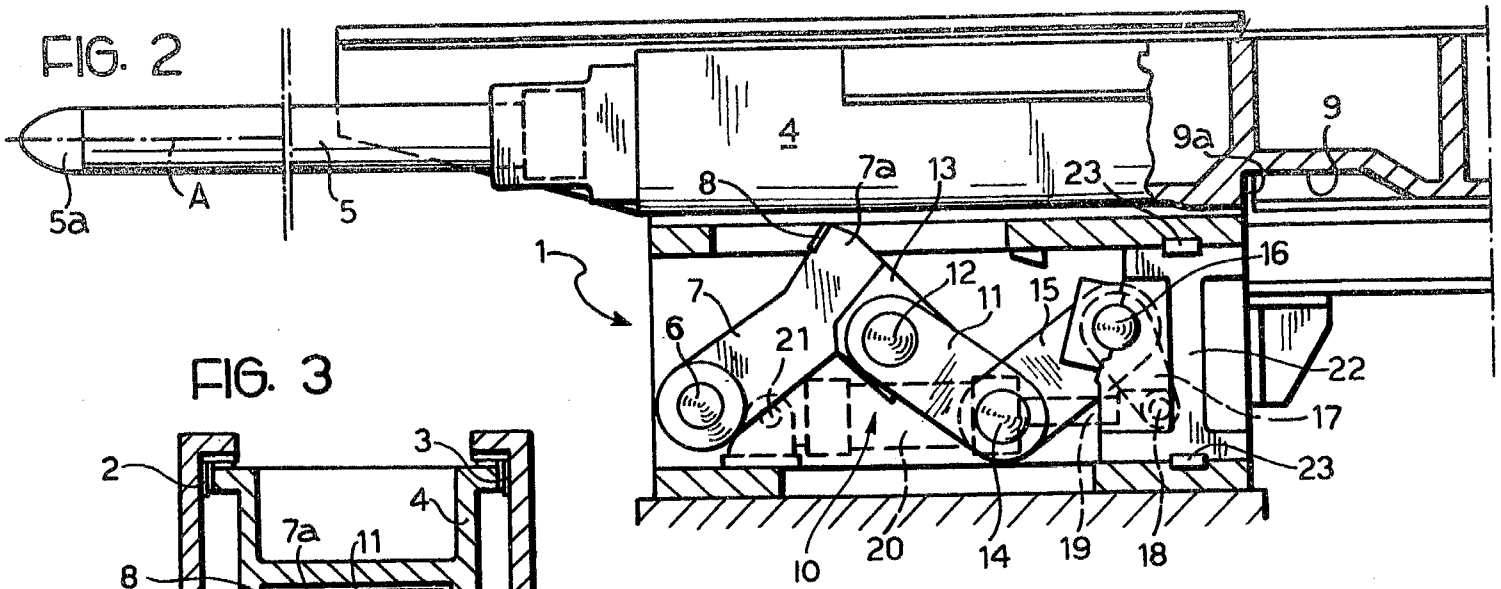
FIG. 2 is a partial cross-sectional view of a device according to the present invention for locking and releasing the mandrel-holding carriage, the device being shown in a different operating position from that illustrated in FIG. 1.
Figure 3:
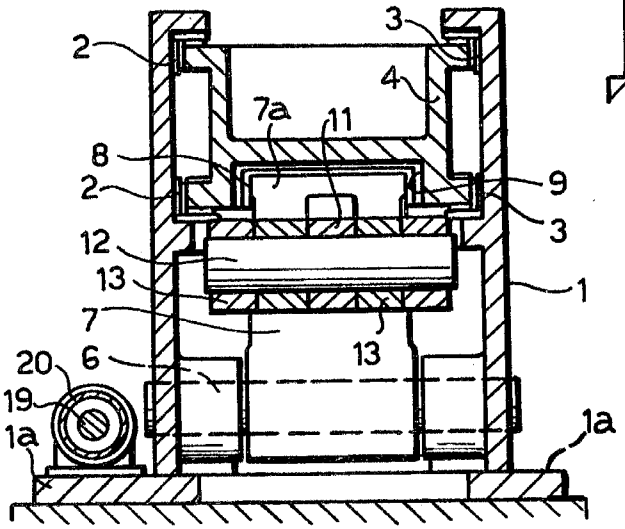
FIG. 3 is a cross section taken along line III—III in FIG. 1.

The device for locking and releasing the mandrel-holding carriage 4 operates as follows:

With reference to FIG. 1, during the operations of rolling and simultaneous axial drilling a square bar in the PPM, carriage 4 is held in the operative position by the free end 7*a* of lever 7 which is engaged in the abutment 9, or more specifically by the flat iron member 8 at end 7*a* engaging shoulder 9*a* of abutment 9.

Under these conditions, rods 11 and 15 of toggle mechanism 10 are in line and the axes of pins 13, 14 and shaft 16 are coplanar. Under these conditions, there is effective opposition to the thrust exerted on the drill bit 5*a*, i.e. on carriage 4, during the aforementioned operations of rolling and axially drilling the bar.

At the moment when the PPM thrust means (not shown) stops, cylinder 20 (FIG. 2) is actuated and rod 19 is extended. This produces an angular rotation of the shaft 16 around its longitudinal axis, and consequently to equal angular movements of levers 11, 15 of toggle mechanism 10. As a result, the free end 7*a* of lever 7 is completely released from the abutment recess 9. Carriage 4 and mandrel 5 secured thereby can therefore be moved back by the rolls, at a speed equal to the rolling speed. The aforementioned actuation of cylinder 20 only has to overcome the forces of inertia and friction, apart from any torques generated by misalignment of pins 12, 14 in the toggle mechanism. Consequently, cylinder 20 can and is actuated at a predetermined speed greater than that at which carriage 4 is moved back, so that the roll-actuating means are not subjected to a recoil at the moment when the PPM thrust member stops, but the rolls can finish rolling the bloom at the PPM outlet.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A device for locking and releasing a mandrel-holding carriage of a piercing pressure mill comprising:

a mandrel-holding carriage selectively movable along a mandrel axis;

at least one lever including a first end pivotally mounted on a horizontal shaft, said horizontal shaft being orthogonally positioned relative to said mandrel axis, and a second end of said lever being selectively rotatable to engage and disengage an abutment formed in said mandrel-holding carriage;

at least one toggle mechanism including a first rod pivotally connected to a second rod, said first rod including a free end being pivotally connected to said second end of said lever and said second rod including a free end being connected to a second horizontal shaft longitudinally displaced along said mandrel axis from said first horizontal shaft;

drive means operatively connected to said second horizontal shaft for actuating said toggle mechanism to selectively rotate said lever to engage and disengage said abutment formed in said mandrel-holding carriage;

said first and second rods being angularly disposed relative to each other upon actuation of said drive means to disengage said lever from said abutment formed in said mandrel-holding carriage; and said first and second rods being aligned relative to each other upon actuation of said drive means to engage said lever with said abutment formed in said mandrel-holding carriage.

2. A device for locking and releasing a mandrel-holding carriage of a piercing pressure mill according to claim 1, wherein said drive means includes a hydraulic cylinder operatively connected to a link affixed to said second horizontal shaft, whereby actuation of said hydraulic cylinder rotates said link and said second horizontal shaft to move said first and second rods into alignment.

3. A device for locking and releasing a mandrel-holding carriage of a piercing pressure mill according to claim 1, wherein said first and second rods comprise a plurality of rods pivotally connected together.

4. A device for locking and releasing a mandrel-holding carriage of a piercing pressure mill according to claim 1, wherein said second rod is keyed to said second horizontal shaft to prevent relative movement therebetween.

* * * * *